US007373683B2

(12) United States Patent
Moon

(10) Patent No.: US 7,373,683 B2
(45) Date of Patent: May 20, 2008

(54) CONSTRUCTION METHOD FOR PRESTRESSED CONCRETE GIRDER BRIDGES

(75) Inventor: Sunghee Moon, Seongnam (KR)

(73) Assignees: BNG Consultant Co., Ltd., Kyonggi-do (KR), part interest; Daewoo E&C., Ltd., Seoul (KR), part interest; Korea Infrastructure Safety & Technology Corporation, Kyonggi-do (KR), part interest ( * ) Notice: Subject to any disclaimer, the term of this patent is extended or adjusted under 35 U.S.C. 154(b) by 261 days.

(21) Appl. No.: 10/555,927

(22) PCT Filed: May 13, 2004

(86) PCT No.: PCT/KR2004/001121

§ 371 (c)(1),
(2), (4) Date: Nov. 8, 2005

(87) PCT Pub. No.: WO2004/101892

PCT Pub. Date: Nov. 25, 2004

(65) Prior Publication Data

US 2007/0056123 A1 Mar. 15, 2007

(30) Foreign Application Priority Data

May 16, 2003 (KR) ..... 10-2003-0031356

(51) Int. Cl.
*E01D 21/00* (2006.01)

(52) U.S. Cl. ..... 14/74.5; 14/77.1

(58) Field of Classification Search ..... 14/74.5, 14/77.1

See application file for complete search history.

(56) References Cited

U.S. PATENT DOCUMENTS

| | | | | |
|---|---|---|---|---|
| 5,479,748 | A * | 1/1996 | Siller | 52/231 |
| 5,655,243 | A * | 8/1997 | Kim | 14/74.5 |
| 5,867,855 | A * | 2/1999 | Kim | 14/77.1 |
| 6,751,821 | B1 * | 6/2004 | Han | 14/74.5 |
| 2006/0137115 | A1 * | 6/2006 | Park | 14/74.5 |

FOREIGN PATENT DOCUMENTS

| | | |
|---|---|---|
| FR | 2 616 166 | 12/1988 |
| JP | 2000-204771 | 1/1999 |
| JP | 10-0349864 | 8/2002 |

* cited by examiner

*Primary Examiner*—Gary S Hartmann
(74) *Attorney, Agent, or Firm*—Bachman & LaPointe, L.C.

(57) ABSTRACT

A construction method for simple bridges or continuous bridges using prestressed concrete girder (PSC girder) and precast slabs (PSC slabs) where prestress is applied to the lower portion of the center of the girder. bridges of low clearance and long span are constructed by preventing a loss of prestress due to load of the slabs and relieving excessive compression force generated on the upper edge portion of the center of the girder during the construction of the bridge.

7 Claims, 3 Drawing Sheets

[Fig. 1]
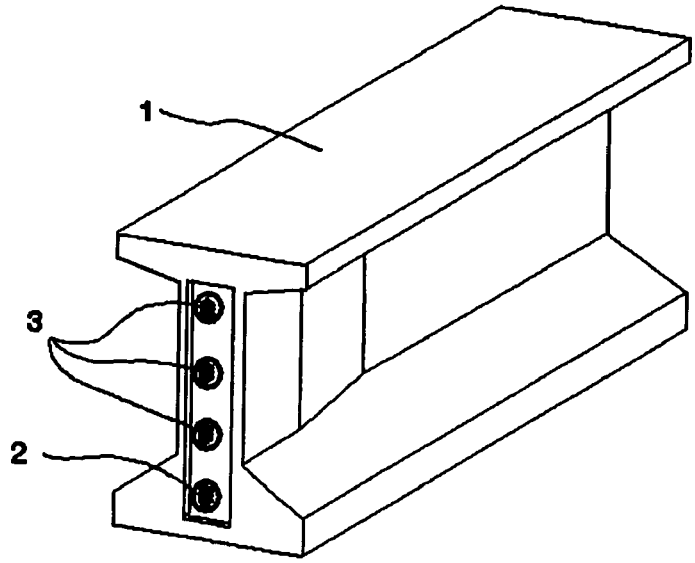
[Fig. 2]
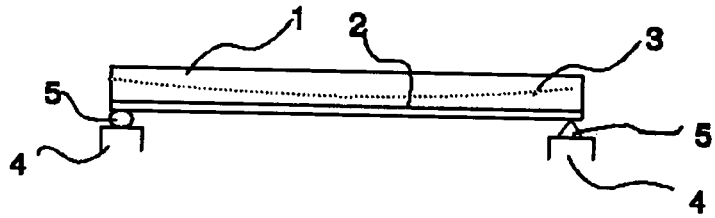
[Fig. 3]
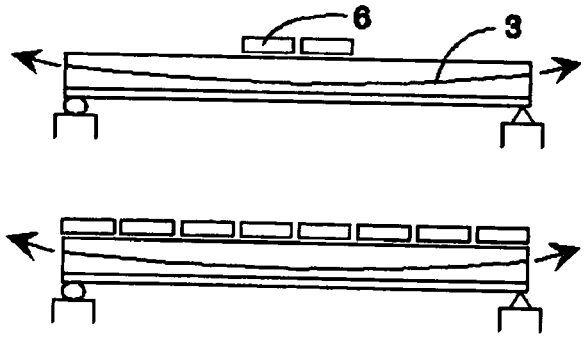
[Fig. 4]
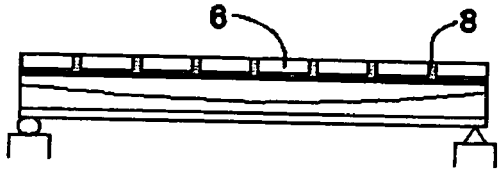

[Fig. 5]
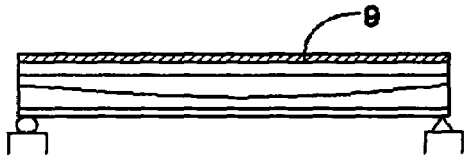
[Fig. 6]
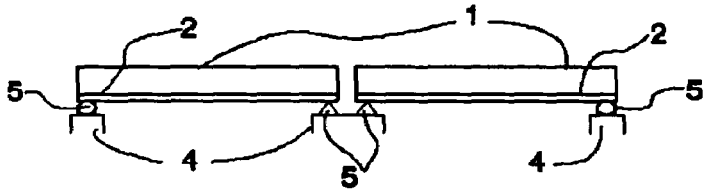
[Fig. 7]
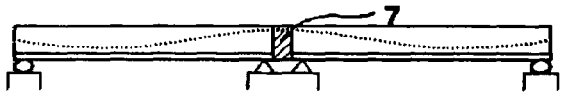
[Fig. 8]
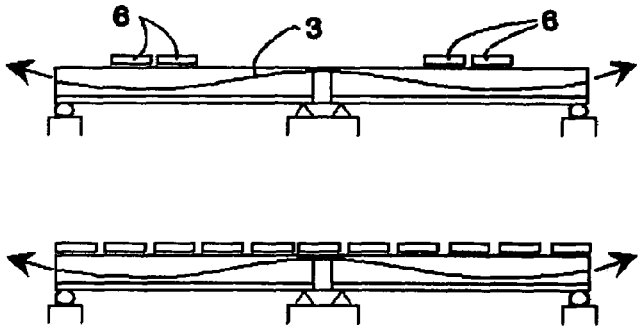
[Fig. 9]
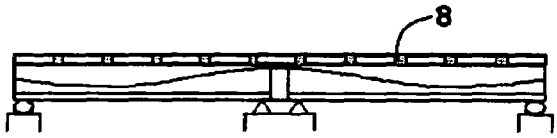
[Fig. 10]
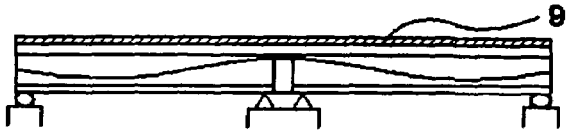

[Fig. 11]
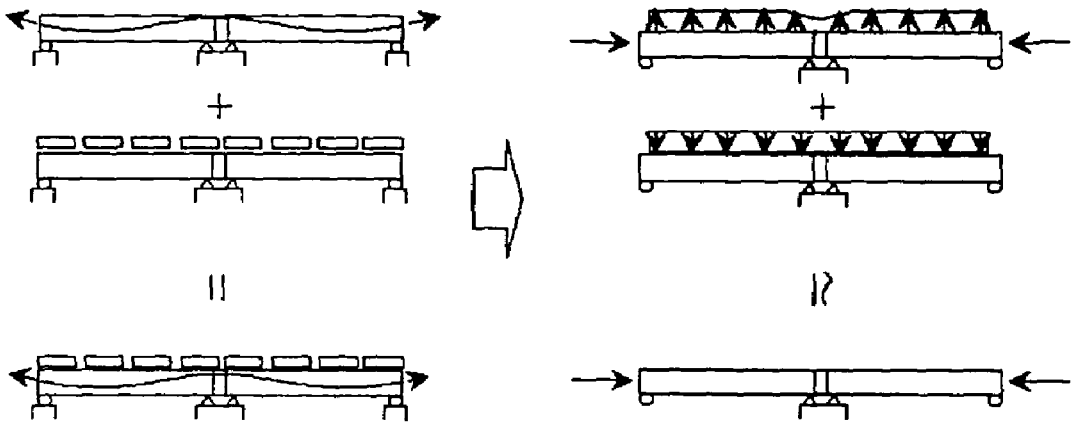
[Fig. 12]
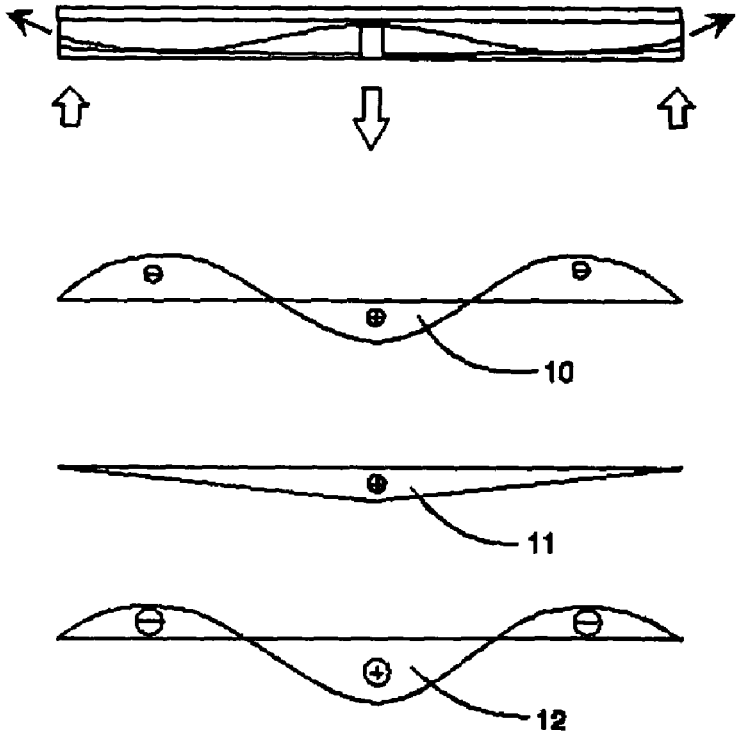

CONSTRUCTION METHOD FOR PRESTRESSED CONCRETE GIRDER BRIDGES

TECHNICAL FIELD

The present invention relates to a construction method for PSC girder (prestressed concrete girder), and more particularly, to a construction method for low clearance long span girder bridges and continuous bridges, which secure a structural continuity, using precast PSC girders and precast slabs.

BACKGROUND ART

In general, when a PSC (prestressed concrete) girder is manufactured, the lower portion of a girder is prestressed to endure load generated during a construction process, such as slabbing or packing. Tendons for prestressing the girder are arranged under the girder, and the section of the girder has very high clearance because excessive tension may generate tensile stress at the upper portion of a beam or compression stress of the lower portion thereof may exceed permissible compression stress. The PSC girder having high clearance has several disadvantages in that moment applied to the girder is increased due to increased self-weight as the PSC girder uses a great deal of concrete, in that aseismatic design of piers is not economical, and in that a bridge spanned above a road is deteriorated in economic efficiency since lots of banks must be made in front and in rear of an area, where a bridge is constructed, to secure a space under the bridge.

To solve the above problems, Korean Patent No. 30131, which was granted on Jun. 25, 2001, discloses a prestressed concrete girder capable of controlling tension force. The prestressed concrete girder, which includes an upper flange located on the lower portion of an upper board of a bridge for supporting the upper board to control load-carrying capacity of the bridge, a web part located on the lower portion of the upper flange for supporting the upper flange, and a lower flange located on the upper portion of a pier for supporting the web part, comprises: a tensed steel wire located in a longitudinal direction of the girder and tensed for supplementing the load-carrying capacity; at least one untensed steel wire located in the longitudinal direction of the girder; at least one connection member for fixing untensed steel wires induced from both ends of the girder; and a cut part formed at a predetermined area of the longitudinal direction to embody the connection member therein. Therefore, the prestressed concrete girder can control tension force of the bridge by tensing the untensed steel wire.

The prior art is not a method for constructing a bridge, but awarding to the prior art, the PSC girder bridge is constructed by a method of spanning a first-tensed PSC girder between piers, establishing surrounding spans during curing after concrete for slabs is poured on the girder in a construction field, and secondly tensing a compound section using an anchoring tool exposed to a side without any influence on the surrounding spans after the curing. However, in the prior art, the first-tensed PSC girder must endure load of the slabs poured in the construction field, and the compound section does not have an effect to remove excessive compression stress of the upper edge portion of the girder due to raised neutral axis even though prestress of the lower edge portion of the girder lost during the pouring of concrete for the slabs can be supplemented by the second tense. Therefore, a key point in design of the PSC girder bridge is to prevent the compression stress of the upper edge portion of the girder from exceeding permissible compression stress by traffic load. In addition, the prior art has a restriction in lowering clearance of the girder by increasing efficiency of tendons.

Meanwhile, according to demands of bridges with long span and to easily maintain spot portions, various methods for constructing a continuous bridge using a PSC girder have been developed. Not completely continuous bridges but continued bridges, which consider only trafficability and maintenance, were constructed before, but recently, construction methods of continuous bridges, which can continue all of the slabs and the girders and prevent cracks of connection parts, have been developed positively.

For this, Korean Patent Publication No. 2001-430, which was published on Jan. 5, 2001, discloses a method for constructing a continuous bridge using prestressed concrete girder having an exposed anchoring device. The method for constructing the continuous bridge using prestressed concrete girders, which includes simple steel wires of at least one group mounted on every girders, continuous steel wires of at least one group passing the plurality of girders, and/or connection steel wires of at least one group for connecting the girders, comprises the steps of: tensing the simple steel wires to the girders, spanning the girders between piers, connecting sheaths to connection parts of the girders and/or arranging the continuous and connection steel wires, pouring concrete for the connection parts and slabs, and applying tension force to the girders by tensing the continuous and/or connection steel wires; and re-tensing the continuous and connection steel wires to prevent droop or cracks of the continuous and connection steel wires and increase load-carrying capacity of the girders when active load acts to the girders and excessive droop and cracks occur due to aging of the girders during use.

The prior art has an advantage to reduce a construction period by simultaneously pouring concrete for the connection parts and concrete for the slabs in such a manner to span the plurality of the first-stressed girders between the piers, arrange the continuous and connection steel wires for the second tense, simultaneously pour and cure the concrete for the connection parts and concrete for the slabs, and then, apply the second tense.

However, the prior art has several problems in that it cannot release the excessive compression stress acting to the upper edge portions of the girders like the simple bridge construction method since the second tense is applied after the slabs are compounded with the girders, in that the first-tensed girders must impose the entire load of the slabs, and in that it cannot obtain a clearance reduction effect through continuity of the girders since the load of the slabs is applied not to the continuous girders but to the simple girders. Furthermore, cracks are generated on border surfaces between the connection parts and the PSC girders due to the first moment by positions of the tendons and due to the second moment by reaction force of continuous spots of the continuous bridge, which is a statically indeterminate structure. In fact, it has been reported that cracks are generated on bridges of national roads, which the prior art construction method was applied. FIG. 5 is a simple view showing the moment generating the cracks on the lower portions of the connection parts during the second tense according to the prior art construction method. In FIG. 5, (+) static moment is to generate tensile stress to the lower portion and compression stress to the upper portion.

To solve the problems of the simple bridges and the continuous bridges constructed by the prior arts, Korean Patent No. 25551, which was filed on Apr. 22, 2003, discloses 'a method for constructing a simple bridge using PSC girders comprising the steps of: spanning PSC girders, which have the first tension force for enduring self-weight, between spot portions; applying the second tense while reapplying temporary load to the girders; removing the load while installing slabs' and 'a method for constructing a continuous bridge using PSC girders comprising the steps of: spanning a number of PSC girders, which have the first tension force for enduring self-weight, between spot portions; pouring concrete for connection parts between the PSC girders after continuously inserting the second tendons into sections of the neighboring PSC girders; applying temporary load while tensing the second tendons continuously inserted into the sections of the PSC girders; and removing the load while installing slabs'.

Such construction method has several advantages in that the second tension force is applied only to the girders, where the slabs are not compounded, because the second tense is performed while a controllable loading device previously applies load, which is applied while the slabs are installed, in that the construction method can prevent tensile cracks generated on border surfaces between the connection parts and the PSC girders due to the second tense and reloading performed at the same time when the continuous bridge is constructed, and in that the moment occurring the girders is reduced and a bridge of low clearance or long span can be constructed since the continuous girders endure the load of the slabs. However, the construction method has a disadvantage in that there is some loss in construction efficiency and economical efficiency since a device for reloading and removing temporary load is required.

DISCLOSURE OF INVENTION

Technical Problem

As described above, the prior arts have a restriction in lowering clearance, and have no solution to prevent cracks of the connection parts generated during the application of prestress for continuity. Furthermore, the recently developed construction methods to solve the above problems are deteriorated in construction efficiency and economical efficiency as requiring the device for reloading and removing temporary load.

Technical Solution

Accordingly, the present invention has been made in view of the above problems, and it is an object of the present invention to provide a construction method for simple bridges or continuous bridges of low clearance and long span using PSC girders (prestressed concrete girder), which can apply the second tens gradually while putting precast slabs on the PSC girders and compound the slabs with the girders after the second tense, thereby preventing excessive compression stress of the upper edge portion of the center of the girder without deteriorating the simple construction efficiency of the bridge using the PSC girders, preventing cracks generated on border surfaces between connection parts and the girders of the continuous bridge, and applying load of the slabs in a continuous girder state.

Advantageous Effects

To achieve the above object, the present invention provides a method for constructing a PSC simple girder bridge using PSC girders, comprising the steps of: tensing a first tendon as much as a PSC girder manufactured in such a manner to insert at least two or more tendons therein endures self-weight thereof, and spanning the PSC girder between bridge seating devices located on piers; gradually tensing second tendons while precast slabs are arranged at regular intervals on the top surface of the PSC girder; compounding the precast slabs and the PSC girder using filling material such as concrete or mortar; and installing additional dead load means such as packing on the compounded structure of the precast slabs and the PSC girder.

In another aspect to achieve the above object, the present invention provides a method for constructing a continuous girder bridge using PSC girders comprising the steps of: spanning PSC girders, which are first tensed as much as the girders endure self-weight thereof, on piers; pouring concrete for connection parts after connecting sheath pipes (not shown) to pass second tendons; secondly tensing second tendons while putting precast slabs on the continuous PSC girders uniformly; pouring filling material for compounding the precast slabs and the PSC girders; and installing additional dead load means such as packing after the compound.

DESCRIPTION OF DRAWINGS

Further objects and advantages of the invention can be more fully understood from the following detailed description taken in conjunction with the accompanying drawings in which:

FIG. 1 is a perspective view of a general PSC girder for applying the present construction method;

FIG. 2 is a view showing a state where the first-tensed PSC girder is spanned between piers;

FIG. 3 is a view showing a process of applying the second tense while putting precast slabs on the PSC girder;

FIG. 4 is a view showing a process of pouring filling material for compounding between the precast slabs and the PSC girder;

FIG. 5 is a view showing a state where additional dead load means, such as packing, a guard fence, or a central trip, is installed after the compound between the precast slabs and the PSC girder;

FIG. 6 is a view showing a state where the first-tensed PSC girders are continuously spanned between the piers;

FIG. 7 is a view showing a state where sheath pipes are connected to pass the second tendons through spaces among the PSC girders and concrete for connection parts is poured;

FIG. 8 is a view showing a process of applying the second tense while putting the precast slabs on the PSC girders uniformly;

FIG. 9 is a view showing a process of pouring the filling material for compounding between the precast slabs and the PSC girder;

FIG. 10 is a view showing a state where additional dead load means, such as packing, a guard fence, or a central trip, is installed after the compound between the precast slabs and the PSC girder;

FIG. 11 is a view showing power applied to continuous girders during performing the second tense while putting the precast slabs in a construction process of a continuous bridge; and FIG. 12 is a view showing moment applied to the girders when the second tense is performed without reloading to the continuous girders in a conventional construction method.

BEST MODE

The present invention will now be described in detail in connection with preferred embodiments with reference to the accompanying drawings.

FIG. 1 shows a sectional form of a general PSC girder 1 to which the present invention can be applied. The present invention can be applied to any PSC girders, which can induce compression force to the girders by tensing and anchoring first and second tendons 2 and 3.

FIG. 2 shows a state where the first-tensed PSC girder 1 is spanned between bridge seating devices 5 located on piers 4. The present invention can reduce loss of tension force by creep of concrete during construction processes because the first tense is performed as much as the PSC girder can endure only self-weight of the PSC girder without excessive tense. The second tendons can be inserted before or after the PSC girder is spanned between the piers 4 or during the girder is manufactured.

FIG. 3 shows a process of performing the second tense while applying load after putting precast slabs 6 are put on the top surface of the girder. Anything one of the process of putting the slabs and the process of performing the second tense can be carried out first because the first-tensed PSC girder can afford to endure additional tense or load if it can prevent excessive compression generated on the upper edge portion of the girder or excessive compression or tension generated on the lower edge portion of the girder. The sum of the first tension force and the second tension force is larger than tension force applied by the conventional construction methods. Moreover, it is good that compression force applied to the lower edge portion of the girder can endure only additional dead load and traffic load excepting the load of the slabs because the second tension force is applied to the girder enduring the load of the precast slabs 6. In addition, compression force generated on the upper edge portion of the girder due to the load of the slabs can be relieved more than tension force generated in a compounded state since tension force is applied in an uncompounded state.

FIG. 4 shows a state where filling material 8 for compounding the precast slabs and the girder is poured. A method for compounding the precast slabs and the girder will not be described since various method for compounding the precast slabs and the girder have been developed and any compounding method can be applied to the present invention.

FIG. 5 shows a form of a simple bridge completed by installing additional dead load means such as packing.

FIGS. 6~10 show an example of two-span continuous bridge for explaining a construction order of the continuous bridge using PSC girders.

FIG. 6 shows a state where the first-tensed PSC girders 1 are continuously spanned between the bridge seating devices 5 located on the piers 4 in order to construct the continuous bridge using the PSC girders. At this time, in various methods, some of the first tension force is applied not to ends of continuous spot portions but to portions where static moment is applied, so that it is prevented that excessive compression stress is generated on the lower portion of the girders adjacent to the continuous spot portions when load is applied to the continuous girders connected to connection parts 7 or the completed continuous bridge.

FIG. 7 shows a state where sheath pipes (not shown) for passing the second tendons 3 for the second tense through spaces between the PSC girders of the continuous spot portions are installed, and concrete for the connection parts 7 is poured. The sheath pipes for passing the second tendons 3 installed within the girders are previously installed inside the PSC girders 1, and connected with each other in the spaces of the connection parts. The second tendons 3 can be inserted before or after concrete for the connection part 7 is poured. In the step of pouring concrete for the connection parts, concrete for slabs is poured in negative moment areas adjacent to the connection parts or the precast slabs can be compounded, so that compression force is applied to the slabs adjacent to the continuous spot portions during the process of performing the second tense, and thereby, the present invention can prevent cracks generated on the slabs of the continuous spot portions due to traffic load.

In FIG. 8, moment by the load of the slabs is offset by tensing the second tendons 3 while the precast slabs 6 are arranged at regular intervals on the top of continuous girders, and thereby, compression force is applied to the girders uniformly. FIG. 11 shows power applied to the continuous PSC girders in the above step. When the second tendons 3 are tensed, compression force is generally applied while reaction force is generated at the spot portions, and at the same time, power for lifting upwardly the span center of the girders is also generated. At this time, in spite of the general compression force, the upper edge portion of the span center of the girders generates tensile stress due to moment by the lifting force, and thereby, excessive compression stress due to various loads is relieved. As a result, the present invention can provide affirmative effects.

FIG. 9 shows a state where filling material is poured to compound the precast slabs 6 and the PSC girders 1, and FIG. 10 shows a form of a bridge completed by installing the additional dead load means such as packing.

INDUSTRIAL APPLICABILITY

As described above, the construction method of PSC girder bridges according to the present invention can provide sufficient tense since the second tense is performed while the precast slabs are put on the girders during the construction process of the bridge, relieve compression force excessively applied to the upper edge portions of the girders as the girders are tensed in the uncompounded state, provide structurally complete continuity by providing cracks of the connection parts of the continuous bridge, and allow an economic design by reducing total moment applied to the girders since the continuous girders impose the load of the slabs. As a result, the present invention can reduce material costs since the bridge manufactured by the present invention has small self-weight, is good in aseismatic design of the piers and in securing overhead clearance due to low clearance, reduce a banking amount for road construction in front or rear of a bridge area, and reduce the number of the piers and provide aesthetic appearance of the bridge structure by constructing the long span bridge.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention

The invention claimed is:

1. A construction method for prestressed concrete (PSC) girder bridges comprising the steps of:

providing a PSC girder with at least first and second tendons;

tensing the first tendon and locating the PSC girder spanning between bridge seating devices;

gradually tensing the second tendon while arranging precast slabs at regular intervals on a top surface of the PSC girder;

compounding the precast slabs and PSC girder using a filler material; and installing additional dead load on the precast slabs.

2. A construction method according to claim 1, including locating the second tendon in the PSC girder after locating the PSC girder between the bridge seating devices.

3. A construction method according to claim 1 or 2, including a sheath in the PSC girder, wherein the second tendon is located in the sheath.

4. A construction method according to claim 3, including providing a plurality of adjacent PSC girders having a space therebetween on bridge seating devices and locating the second tendon in the adjacent PSC girders.

5. A construction method according to claim 4, including pouring a concrete connection part in the space between the adjacent PSC girders.

6. The construction method for PSC continuous girder bridges according to claim 5, wherein when the concrete for the connection parts is poured, the compounding for slabs is simultaneously poured adjacent to continuous spot portions, wherein compression stress is applied to the slabs adjacent to the continuous spot portion during the second tensing of the second tendon.

7. The construction method for PSC continuous girder bridges according to claim 5, wherein at least some of the first tensing of the first tendon is applied to portions of the PSC girder where static moment is applied wherein excessive compression stress is prevented from being generated on a lower edge portion of the PSC girder adjacent to a continuous spot portion when load is applied to the girder.

* * * * *